United States Patent [19]

Vanegmond et al.

[11] Patent Number: 4,572,299

[45] Date of Patent: Feb. 25, 1986

[54] HEATER CABLE INSTALLATION

[75] Inventors: Cor F. Vanegmond; Peter Van Meurs, both of Houston, Tex.

[73] Assignee: Shell Oil Company, Houston, Tex.

[21] Appl. No.: 666,528

[22] Filed: Oct. 30, 1984

[51] Int. Cl.[4] ..... E21B 36/04

[52] U.S. Cl. ..... 166/385; 166/302; 166/60; 219/278

[58] Field of Search ..... 166/57, 60, 61, 77, 166/248, 302, 385; 219/277, 278

[56] References Cited

U.S. PATENT DOCUMENTS

| | | | |
|---|---|---|---|
| 1,701,884 | 2/1929 | Hogle | 219/277 |
| 2,781,851 | 2/1957 | Smith | 166/60 |
| 4,452,314 | 6/1984 | Zion | 166/328 |
| 4,523,645 | 6/1985 | Moore | 166/77.5 |

*Primary Examiner*—James A. Leppink
*Assistant Examiner*—William P. Neuder

[57] ABSTRACT

A well heater is installed in a well by spooling electrical cable assemblies for heating and supplying power, in proper sequence, on at least one spooling means, unspooling them and attaching them to a heat- and tension-stable support means as the resulting assembly is drawn into the well by a weight attached to the support means.

10 Claims, 6 Drawing Figures

FIG.1
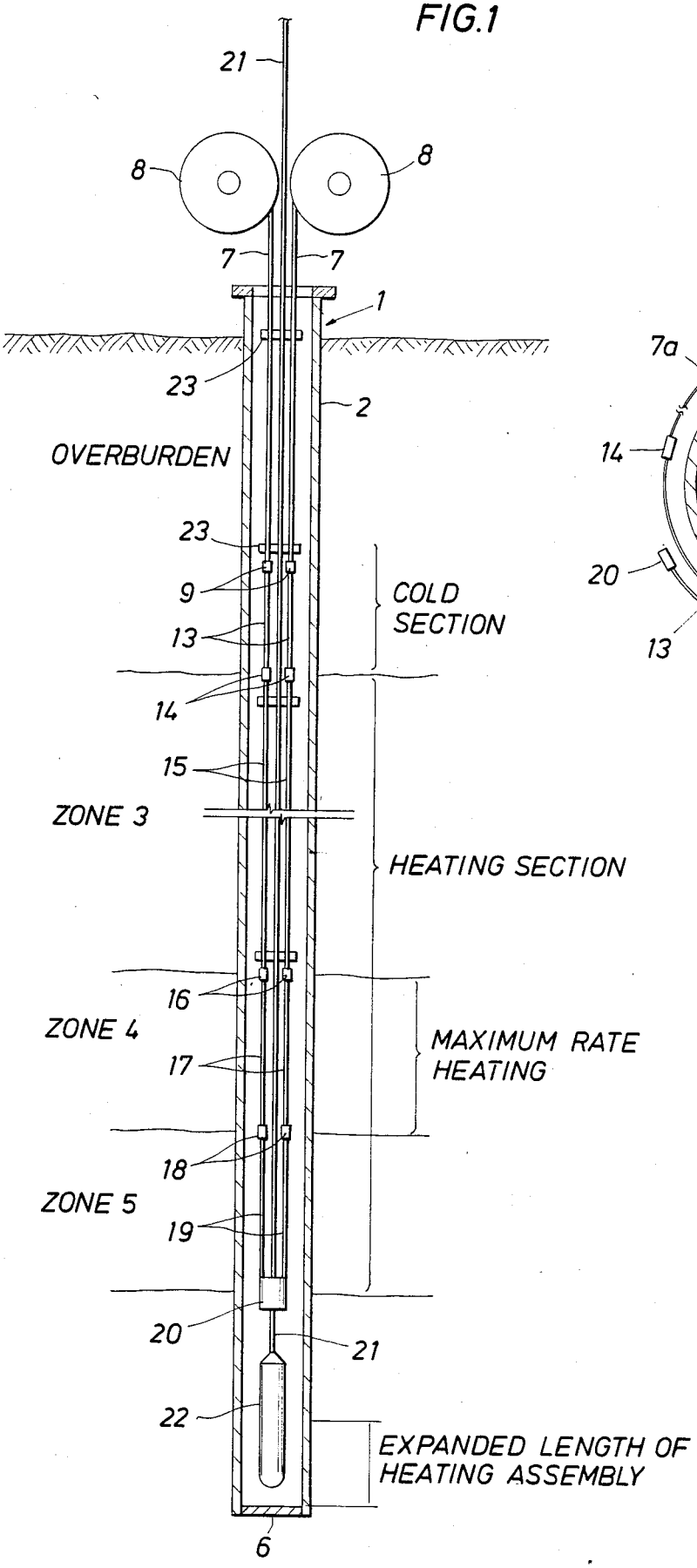
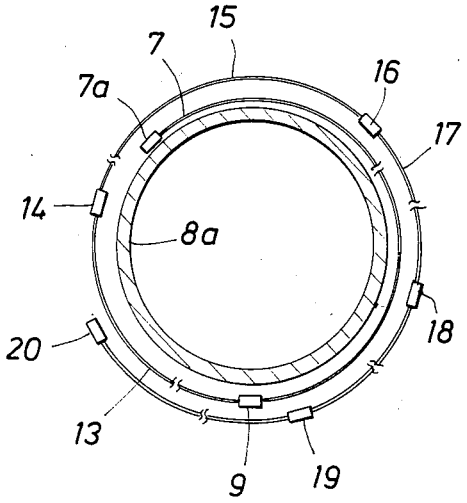
FIG. 2

FIG. 6
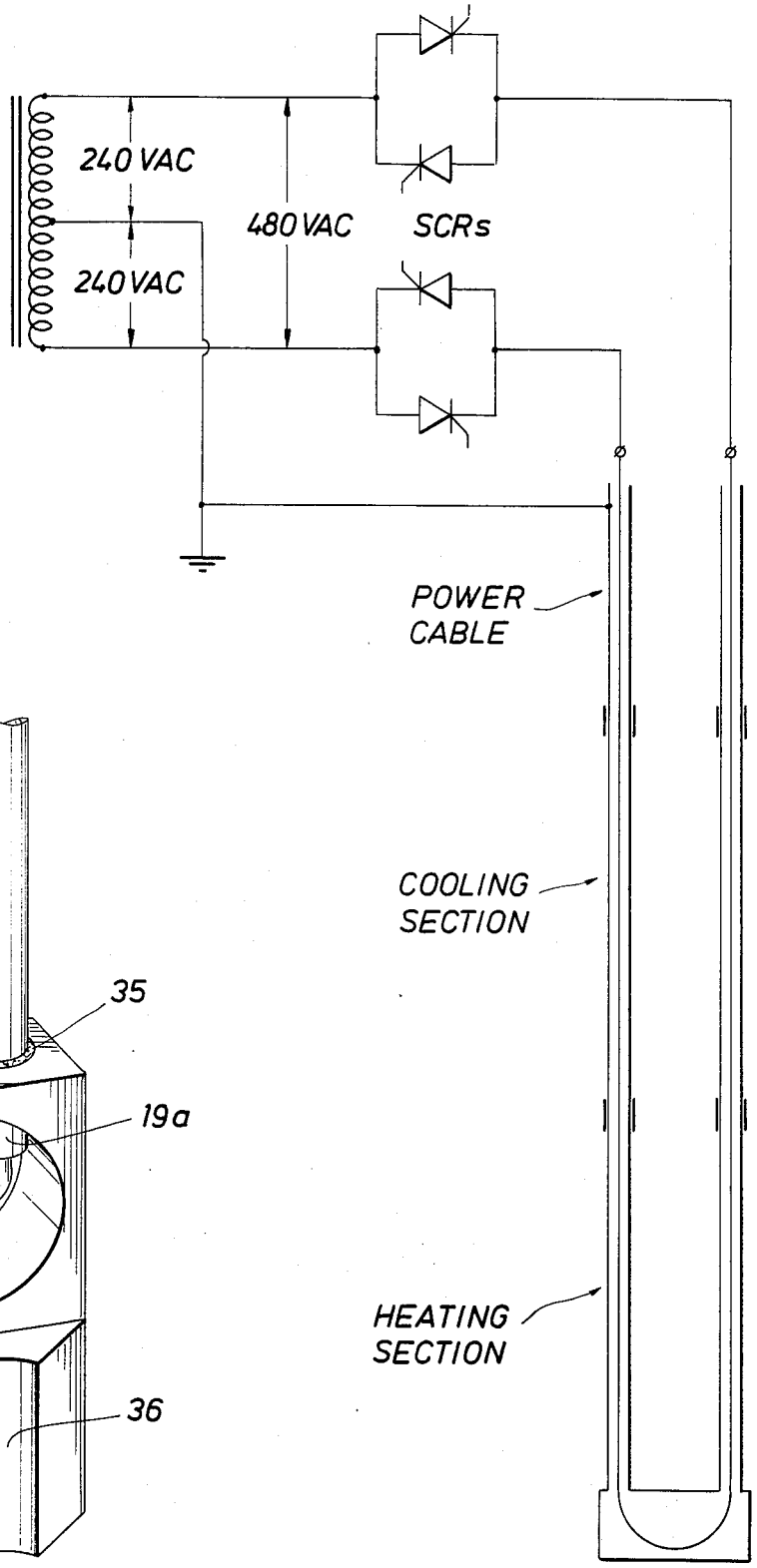
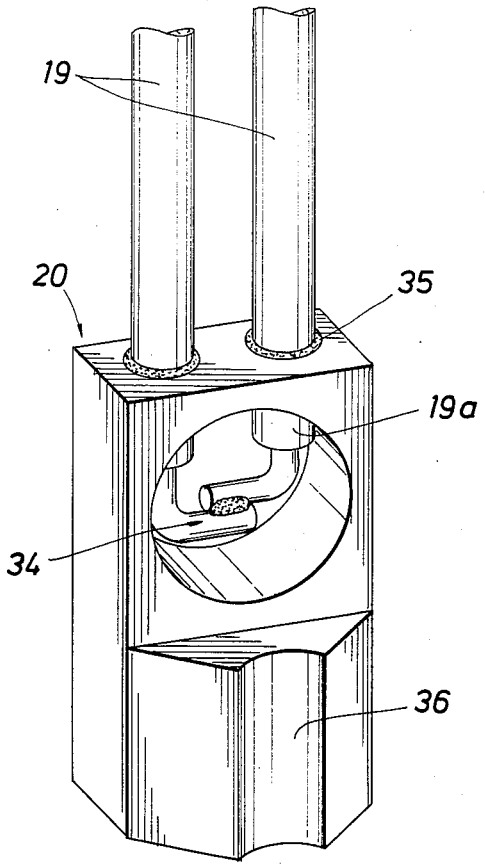
FIG. 5

HEATER CABLE INSTALLATION

CROSS REFERENCE TO RELATED APPLICATIONS

Commonly assigned patent application Ser. No. 597,764 filed Apr. 6, 1984, by P. VanMeurs and C. F. VanEgmond relates to electrical well heaters comprising metal sheathed mineral-insulated cables capable of heating long intervals of subterranean earth formations at high temperatures, with the patterns of heat generating resistances within the cables being arranged in correlation with the patterns of heat conductivity within the earth formations to transmit heat uniformly into the earth formations.

Commonly assigned patent application Ser. No. 658,238 filed Oct. 15, 1984 by G. L. Stegemeier, P. VanMeurs and C. F. VanEgmond relates to measuring patterns of temperature with distance along subterranean intervals by extending a spoolable heat stable conduit from a surface location to the interval and logging the temperature within the interval with a telemetering temperature sensing means while moving the measuring means by remotely controlled cable spooling means arranged for keeping the measuring means in substantial thermal equilibrium with the surrounding temperatures throughout the interval being logged.

The disclosures of the above patent applications are incorporated herein by reference.

BACKGROUND OF THE INVENTION

The present invention relates to a process for forming and installing an electrical heater which is capable of heating a long interval of subterranean earth formation and, where desired, is arranged to facilitate the temperature logging of the heated zone through a thermal well conduit extending from a surface location to the interval being heated.

It is known that benefits can be obtained by heating intervals of subterranean earth formations to relatively high temperatures for relatively long times. Such benefits may include the pyrolyzing of an oil shale formation, the consolidating of unconsolidated reservoir formations, the formation of large electrically conductive carbonized zones capable of operating as electrodes within reservoir formations, the thermal displacement of hydrocarbons derived from oils or tars into production locations, etc. Prior processes for accomplishing such results are contained in patents such as the following, all of which are U.S. patents. U.S. Pat. No. 2,732,195 describes heating intervals of 20 to 30 meters within subterranean oil shales to temperatures of 500° to 1000° C. with an electrical heater having iron or reusable chromium alloy resistors. U.S. Pat. No. 2,781,851 by G. A. Smith describes using a mineral-insulated and copper-sheathed low resistance heater cable containing three copper conductors at temperatures up to 250° C. for preventing hydrate formation, during gas production, with that heater being mechanically supported by steel bands and surrounded by an oil bath for preventing corrosion. U.S. Pat. No. 3,104,705 describes consolidating reservoir sands by heating residual hydrocarbons within them until the hydrocarbons solidify, with "any heater capable of generating sufficient heat" and indicates that an unspecified type of an electrical heater was operated for 25 hours at 1570° F. U.S. Pat. No. 3,131,763 describes an electrical heater for initiating an underground combustion reaction within a reservoir and describes a heater with resistance wire helixes threaded through insulators and arranged for heating fluids, such as air, being injected into a reservoir. U.S. Pat. No. 4,415,034 describes a process for forming a coked-zone electrode in an oil-containing reservoir formation by heating fluids in an uncased borehole at a temperature of up to 1500° F. for as long as 12 months.

Various temperature measuring processes have been described in patents. U.S. Pat. No. 2,676,489 describes measuring both the temperature gradient and differential at locations along a vertical line in order to locate the tops of zones of setting cement. U.S. Pat. No. 3,026,940 discloses the need for heating wells for removing paraffin or asphalt or stimulating oil production and discloses the importance of knowing and controlling the temperature around the heater. It describes a surface located heater that heats portions of oil being heated by a subsurface heater, with the extent of the heater control needed to obtain the desired temperature at the surface located heater being applied to the subsurface heater.

Various temperature measuring systems involving distinctly different types of sensing and indicating means for uses in wells have also been described in U.S. patents. For example, patents such as Nos. 2,099,687; 3,487,690; 3,540,279; 3,609,731; 3,595,082 and 3,633,423 describe acoustic thermometer means for measuring temperature by its effect on a travel time of acoustic impulses through solid materials such as steel. U.S. Pat. No. 4,430,974 describes a measuring system for use in wells comprising contacting a plurality of long electrical resistant elements (grouted in place) with a scanner for sequentially connecting a resistance measuring unit to each of the resistance elements. U.S. Pat. No. 3,090,233 describes a means for measuring temperatures within small reaction zones such as those used in pilot plants. A chain drive mechanism pushes and pulls a measuring means such as a thermocouple into and out of a tube extending into the reaction zone while indications are provided of the temperature and position within the tube.

SUMMARY OF THE INVENTION

The present invention relates to installing an electrical heater within a well. A spooled assembly of electrically conductive cables is provided by spooling them on at least one spooling means drum in an arrangement such that at least one power supply cable having an innermost end adapted for subsequent attachment to a power supply source and an outermost end connected to a metal-sheathed heat-stable power-transmitting cable which is connected to at least one metal-sheathed resistance-heating cable having an outermost end which is, or is adapted to be, electrically interconnected to at least one other metal-sheathed heat-stable heating or other circuit completeing electrical conductor. A relatively flexible strand which is heat and tension stable and is capable of supporting the weight of the heating and power transmitting cables within a well at the temperature provided by the heating cables is arranged on a separate spooling means with its innermost end adapted for subsequent suspension within a wellhead and its outermost end adapted to be attached to a weighting means capable of pulling the strand downward within the well while substantially straightening the bending imparted by the spooling means drum. The dimensions and properties of said cables, strand and spooling means drums, are correlated with those of the well, the interval to be heated and the temperature to be used, so that the power supply cables, metal-sheathed power transmitting cables, heater cables and flexible strand are adapted to extend, respectively, from a surface location to the subterranean locations selected for each of the upper ends of the power transmitting and heating cables and a selected distance below the bottom of the heating cables, while the electrical resistances of the cable are arranged for conducting the current required for generating the temperature to be employed without significant heat being generated by the power supply cables or heat power transmitting cables. The cables and the flexible strand are concurrently unspooled into the well with the weight being attached to the flexible strand and the outermost ends of the heater cables being interconnected and all of the cables being attached to the flexible strand before being moved into the well.

In a preferred embodiment the flexible strand can be a spoolable heat stable conduit capable of serving as a thermowell through which a temperature logging apparatus can be operated from a surface location to measure the temperature with distance along the interval being heated, such as the logging device described in the copending application, Ser. No. 658,238 filed Oct. 15, 1984.

BRIEF DESCRIPTION OF THE DRAWINGS

FIG. 1 is a schematic illustration of a heater which can be installed in accordance with the present invention within a well.

FIG. 2 is a schematic illustration of a preferred arrangement involving a pair of power supply cables connected to both power transmitting and heating cables and wound on a single drum.

FIG. 5 is a three-dimensional illustration of an arrangement for interconnecting the bottom ends of a pair of heating cables in a manner suitable for use in the present invention.

FIG. 6 is a diagrammatic illustration of a power circuit arrangement suitable for use on a heater installed in accordance with the present invention.

DESCRIPTION OF THE INVENTION

Figure 3:
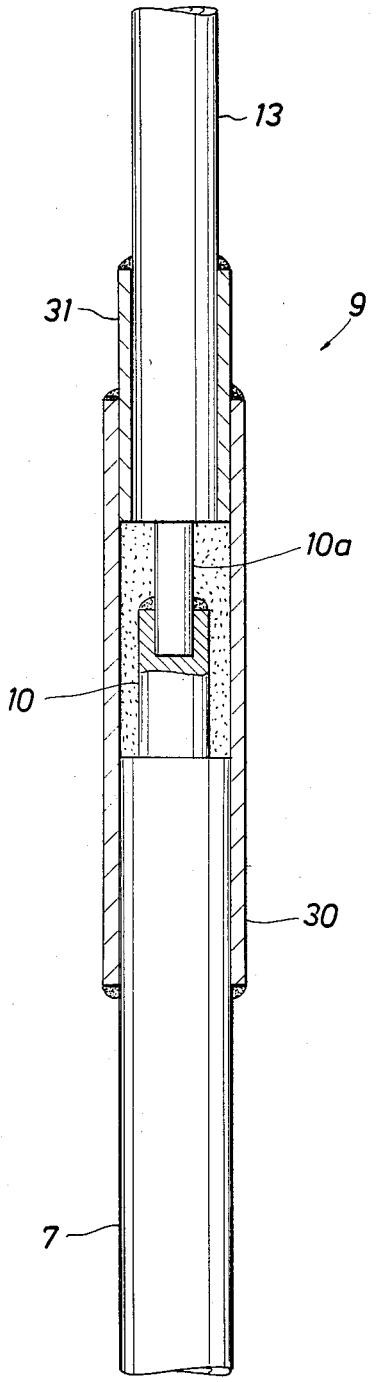
FIGS. 3 and 4 are illustrations of splices of copper and steel-sheathed metal cables suitable for use as cable connections in the present invention.

Applicants have discovered that an electrical heater, such as a heater of the type described in the patent application Ser. No. 597,764, can advantageously be made and installed by the presently described procedures. The dimensions and properties of the power supplying and transmitting and heating cables as well as a flexible strand for supporting their weight, can be correlated with the properties of the well, the interval of earth formations to be heated and the temperature at which the heating is to be conducted. The completing of the necessary arrangements and connections of the cables can be effected while part or all of the cables are located on the drum of a spooling means. This provides spooled assemblies which can be transported to the field location and operated there to install long heaters within wells substantially as rapidly as is common in running in continuous strands which are to be strapped or clamped together. In a preferred embodiment in which the weight supporting strand is a continuous stainless steel tube, the resulting heater can be used in conjunction with logging systems of the type described in the application, Ser. No. 658,238, filed Oct. 15, 1984 to provide an automatically monitored heating system.

FIG. 1 shows a well 1 which contains a casing 2 and extends through a layer of "overburden" and zones 3, 4 and 5 of an interval of earth formation to be heated. Casing 2 is provided with a fluid-tight bottom closure 6, such as a welded closure, and, for example, a grouting of cement (not shown) such as a heat-stable but heat-conductive cement.

Such a flow preventing well completion arrangement is preferably used in the present process for providing a means for ensuring that heat in the borehole of the well will be conductively transmitted into the surrounding earth formations. This is ensured by preventing any flow of fluid between the surrounding earth formations and a heater which is surrounded by an impermeable wall, such as a well casing. This isolates the heating elements from contact with fluid flowing into or out of the adjacent earth formations and places them in an environment substantially free of heat transfer by movement of heated fluid. Therefore, the rate at which heat generated by the heating elements is removed from the borehole of the well is substantially limited to the rate of heat conduction through the earth formations adjacent to the heated portion of the well.

As seen from the top down, the heater assembly consists of a pair of spoolable electric power supply cables 7 being run into the well from spools 8. Particularly suitable spoolable cables consist of copper conductors insulated by highly compressed masses of particles of magnesium oxide which insulations are surrounded by copper sheaths, the MI power supply cables available from BICC Pyrotenax Ltd. exemplify such cables.

Splices 9 connect the power cables 7 to heat-stable "cold section" power transmission cables 13. The cables 13 provide a cold section above the "heating section" of the heater assembly. (Details of the splices 9 are shown in FIG. 3). The cold section cables 13 as well as the power cables to which they are spliced are preferably spoolable cables constructed as shown in FIG. 3. The cold section cables 13 each have a metallic external sheath which has a diameter near that of the power cable but is constructed of a steel which preferably is, or is substantially equivalent to, stainless steel. Relative to the power supply cables 7, the conductors or cores of the cold section cables 13 have cross-sections which are smaller but are large enough to enable the cold section cables to convey all of the current needed within the heating section without generating or transmitting enough heat to damage the copper or other sheaths on the power cables or the splices that connect them to the cold section cables.

Figure 4:
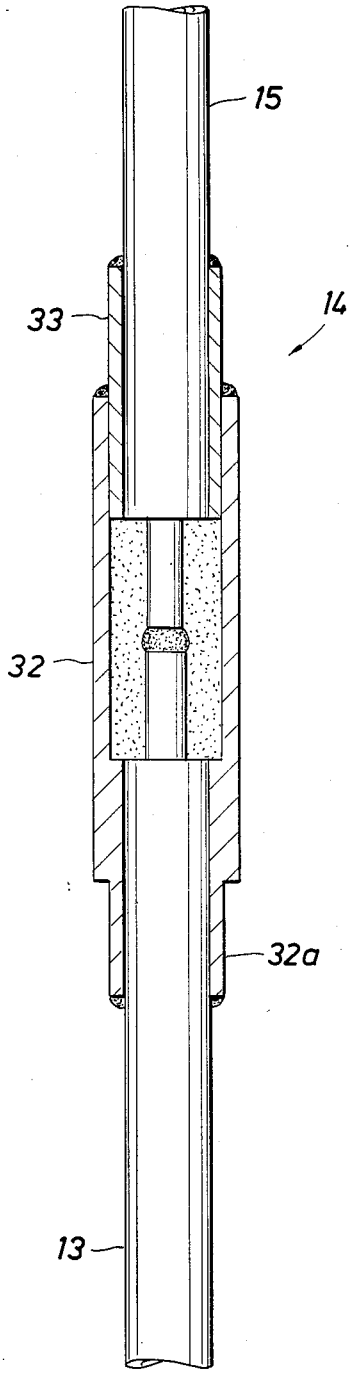

At splices 14 the cold section cables 13 are connected to moderate-rate heating-element cables 15. (Details of the splices 14 are shown in FIG. 4.) In the moderate-heating-rate cables 15 the cross-sectional area of a core such as a copper core is significantly smaller than the core of the cold section cable 13. The relationship between the cross-sectional area of the current carrying core in cable 15 to the resistance of that in cable 13 is preferably such that cable 15 generates a selected temperature between about 600° to 1000° C. in response to a selected EMF of not more than about 1200 volts between the cores and sheaths. Of course, where desired, the cables used in a given situation can include numerous gradations of higher or lower rates of heating.

At splices 16 the moderate-rate-heating cables 15 are joined with maximum-rate heating cables 17. The constructions of the cables 15 and 17 and splices 16 and 18 are the same except that the cables 17 contain electrically conductive cores having smaller cross-sectional areas for causing heat to be generated at a rate which is somewhat higher than the moderate rate generated by cables 15 in response to a given EMF.

Splices 18 connect the maximum rate heating cables 17 to moderate rate heating cables 19. Splices 18 can be the same as splices 16 and cables 19 can be the same as cables 15.

At the end-piece splice 20 the current conducting cores of the cables 19 are welded together within a chamber in which they are electrically insulated. (Details of the end-piece splice 20 are shown in FIG. 5.) Where desirable, a single assembly of electrical cables can be arranged to supply a heating cable 19, serving as a single heating leg, to an electrical conductor (such as a ground or return line) other than another heating cable.

The end-piece splice 20 is mechanically connected to a structural support member 21 which is weighted by a sinker bar 22. The support member 21 is arranged to provide vertical support for all of the power and heating cable sections by means of intermittently applied mechanical connecting brackets or bands 23. Bands, such as band 23 are attached around the cables 19 and support member 21 and tightened so that the friction between the cables and a weight-supporting member is sufficient to support the weight of the cables between each of the bands. Mechanical banding or strapping devices which pull a flexible band such as a steel band through a collar position while applying tightening force and crimping the collar portion to hold the bands in place are commercially available and are suitable for use in this invention. For example, a suitable banding system comprises the Signode Air Binder Model PNSC34 and other suitable systems, are available from Reda or Centrilift Pump Corporations.

Where, as shown in FIG. 1, the interval of earth formations to be heated contains a relatively highly heat-conductive zone such as zone 4, the tendency for that zone to cause a zone of relatively low temperature along the heater can be compensated for by, for example, splicing in a relatively high rate heating section of cables, such as cables 17.

FIG. 2 shows an arrangement for spooling one or both of the electrical cable assemblies shown in FIG. 1 on the drum of a spooling means 8. As shown, the innermost end (relative to the spooling means) of power cable 7 is equipped with an end-piece **7*a* which is, or can be connected to, a connector for attachment to a source of electrical power. The cable is wound onto the drum surface 8*a* of the spooling means 8. The outermost end of cable 7 is connected, by splice 9, to cable 13 which is connected, by splice 14, to cable 15, etc. Such connections are preferably completed before or during spooling of the cables onto the spooling means. Where a two-legged heater is to be formed by a pair of electrical cables and both cable assemblies are to be spooled onto the same drum, an end splice 20*a* for interconnecting the heater cables can advantageously be connected to the heater cables before the cables are unspooled into contact with the structure support member 21**, during their installation within the well.

FIG. 3 illustrates details of the splices 9. As shown in the figure, the power cable 7 has a metal sheath, such as a copper sheath, having a diameter which exceeds that of the steel sheathed cold section cable 13. The central conductors of the cables are joined, preferably by welding. A relatively short steel sleeve 30 is fitted around, and welded or braised to, the metal sheath of cable 7. The inner diameter of sleeve 30 is preferably large enough to form an annular space between it and the steel sleeve of cable 13 large enough to accommodate a shorter steel sleeve 31 fitted around the sheath of cable 13. Before inserting the short sleeve 31, substantially all of the annular space between the central members 10 and **10*a* and sleeve 30 is filled with powdered mineral insulating material such as magnesium oxide. That material is preferably deposited within both the annular space between the central members and sleeve 30 and the space between sleeve 30. The sheath of cable 13 is preferably vibrated to compact the mass of particles. Sleeve 31 is then driven into the space between sleeve 30 and the sheath of cable 13 so that the mass of mineral particles is further compacted by the driving force. The sleeves 30 and 31 and the sheath of cable 13** are then welded together.

FIG. 4 illustrates details of the splices 14, which are also typical of details of other splices in the steel sheathed heating section cables, such as splices 16 and 18. The splice construction is essentially the same as that of the splices 9. However, the steel sleeve 32 is arranged, for example, by machining or welding to have a section **32*a* with a reduced inner diameter which fits around the sheath of cable 13 and a larger inner diameter which leaves an annular space between the sleeve 32 and the sheath of cable 15. After welding the central conductors together, the sleeve portion 32*a* is welded to the sheath of cable 13. The annular space between the sleeve 32 and the central conductors is filled with powdered insulating materials, a short sleeved section 33 is driven in to compact particles and is then welded to the sheath of cable 15**.

FIG. 5 illustrates details of the end splice 20. As shown, cables 19 are extended through holes in a steel block 20 so that short sections **19*a* extend into a cylindrical opening in the central portion of the block. The electrically conductive cores of the cables are welded together at weld 34 and the cable sheaths are welded to block 20 at welds 35. Preferably, the central conductors of the cables are surrounded by heat stable electrical insulations such as a mass of compacted powdered mineral particles and/or by discs of ceramic materials (not shown), after which the central opening is sealed, for example, by welding-on pieces of steel (not shown). Where the heater is supported as shown in FIG. 1, by attaching it to an elongated cylindrical structural member 21, a groove 36 is preferably formed along an exterior portion of end splice 20** to mate with the structural member and facilitate the attaching of the end piece to that member.

When a well heater is emplaced in a borehole and operated at a temperature of more than about 600° C., loading (i.e., weight/cross sectional area of weight-supporting elements) thermal expansion, and creep, are three factors which play an important role in how the heater can be positioned and maintained in position (for any significant period of time). For example, for a heater constructed and mounted as illustrated in FIG. 1, where the central structural member 21 is a stainless steel tube having a diameter of one-half inch and a wall thickness of 11/16ths inch, since the coefficient for thermal expansion for both steel and copper is about 9 times $10^{-6}$ inches per inch, per degree Fahrenheit, a 1000-foot long heating section would expand to 1013 feet by the time it reached a temperature of 800° C.

When using the arrangement illustrated in FIG. 1, space is preferably allowed for such expansion. The heater is preferably positioned so that, after expansion, the lower part is carrying its weight under compression loading (because it is resting on the bottom of the borehole or surrounding casing) while the upper part is still hanging and is loaded under tension, with a neutral point being located somewhere in the middle.

Due to the creep rate of stainless steel, with a typical loading factor of about 7000 psi on stainless steel structural members of a heater, at 700° C. the length of a 1000-foot heating section would increase by 0.012-inch per hour or 105 inches per year or 87.5 feet in 10 years—if it was not ruptured before then.

What is claimed is:

1. A process for installing an electrical heater within a well comprising:

spooling and arranging electrical cables to provide at least one spooling means drum containing at least one power supply cable with an innermost end arranged for subsequent connection to a surface located electrical power source and an outermost end connected to one or a series of end-to-end connected metal-sheathed heat-stable power transmitting cables which in turn are spliced to a metal-sheathed temperature stable heating cable having its outermost end connected to, or adapted to be connected to, at least one other heating cable or other circuit-completing electrical conductor;

spooling a relatively flexible strand which is heat and tension stable and is capable of supporting the weight of said cables within a well at the temperature provided by said heating cables with the strand being arranged with an innermost end capable of being suspended within a wellhead and an outermost end capable of being attached to a weight for pulling the strand into the well;

correlating the dimensions and properties of said cables and strands so that the power supply cables, power transmission cables, heater cables and strand have lengths arranged for (a) extending from a surface location to, respectively, the depths selected for the top of the power transmission cables and the heater cables and bottom ends of the heater cables and weight supporting strand and (b) having electrical resistances within the cables such that, while conducting the current required for generating the temperature to which the interval of earth formations is to be heated, relatively insignificant amounts of heating occurs above the interval to be heated; and concurrently unspooling said cables and weight supporting strand into the well while attaching the weighting means to the outermost end of the strand, interconnecting the heater cables and attaching all of the cables to at least portions of the strand before those items are lowered into the well.

2. The process of claim 1 in which the cable spooling means drum is sized to avoid bending portions of the cables adjacent to the cable-to-cable connections beyond their elastic limits.

3. The process of claim 1 in which the well contains a casing which is sealed at its bottom end and into which the cables and strand are installed.

4. The process of claim 1 in which the power supply cables and the heat stable cables are respectively copper and stainless steel sheathed cables.

5. The process of claim 1 in which the weight supporting strand is a spoolable metal tube capable of serving as a thermowell for a thermocouple logging system.

6. The process of claim 5 in which the spoolable metal tube is a stainless steel tube.

7. The process of claim 1 in which the interval to be heated is longer than 100 feet and the temperature at which it is to be heated is greater than 600° C.

8. The process of claim 1 in which the cable-to-cable connections are splices between power supply and power transmitting cables which are made while most of the innermost ones of said cables are disposed on the spooling means drum.

9. The process of claim 8 in which one spooling means drum contains a pair of heating cables the outer ends of which are electrically interconnected while most of the cables are disposed on the drum.

10. The process of claim 1 in which three heating cables and associated power providing cables are interconnected with a three-phase power supply system.

* * * * *